US009643301B2

(12) United States Patent
Chen

(10) Patent No.: US 9,643,301 B2
(45) Date of Patent: May 9, 2017

(54) IMPACT DEVICE FOR POWER TRANSMISSION

(71) Applicant: TRANMAX MACHINERY CO., LTD., Taichung (TW)

(72) Inventor: Hsin-Chi Chen, Taichung (TW)

(73) Assignee: Tranmax Machinery Co., Ltd., Taichung (TW)

( * ) Notice: Subject to any disclaimer, the term of this patent is extended or adjusted under 35 U.S.C. 154(b) by 449 days.

(21) Appl. No.: 14/337,677

(22) Filed: Jul. 22, 2014

(65) Prior Publication Data

US 2015/0343622 A1 Dec. 3, 2015

(30) Foreign Application Priority Data

May 30, 2014 (TW) ..... 103119158 A

(51) Int. Cl.
*B25B 21/02* (2006.01)
*B25B 23/145* (2006.01)

(52) U.S. Cl.
CPC ..... *B25B 23/1453* (2013.01); *B25B 21/02* (2013.01)

(58) Field of Classification Search
CPC .... B25B 21/02; B25B 23/145; B25B 23/1453
USPC ..... 173/104, 93, 93.6, 93.5, 176, 21, 168, 173/218, 169, 177
See application file for complete search history.

(56) References Cited

U.S. PATENT DOCUMENTS 4,635,731 A * 1/1987 Wallace ..... B25B 23/1453 173/177
5,092,410 A * 3/1992 Wallace ..... B25B 23/1453 173/93.5
5,217,079 A * 6/1993 Kettner ..... B25B 23/1453 173/177
5,531,279 A * 7/1996 Biek ..... B25B 21/02 173/178
5,544,710 A * 8/1996 Groshans ..... B25B 21/02 173/176
5,591,070 A * 1/1997 Kachich ..... B24B 23/026 173/169
5,704,434 A 1/1998 Schoeps
6,082,986 A * 7/2000 Seward ..... F01C 13/02 418/268
6,179,063 B1 * 1/2001 Borries ..... B25B 21/02 173/177
6,241,500 B1 * 6/2001 Ellis ..... B25B 21/02 418/1
6,334,494 B1 * 1/2002 Nagato ..... B25B 23/1453 173/177

(Continued)

*Primary Examiner* — Scott A. Smith
(74) *Attorney, Agent, or Firm* — Muncy, Geisler, Olds & Lowe, P.C.

(57) ABSTRACT

An impact device for power transmission includes an impact unit and a hydraulic pressure adjusting unit. The impact unit has a hydraulic cylinder which is installed with a piston assembly and an output shaft therein for outputting torque through the output shaft by utilizing a hydraulic pressure provided in the hydraulic cylinder. The hydraulic pressure adjusting unit is disposed in the hydraulic cylinder and operative to adjust the hydraulic pressure of the hydraulic cylinder. Therefore, the impact device for power transmission can generate a hydraulic torque pulse, and the magnitude of the output torque can be adjusted by the hydraulic pressure adjusting unit.

9 Claims, 7 Drawing Sheets

(56) References Cited

U.S. PATENT DOCUMENTS 7,032,685 B2 * 4/2006 Nakamizo ..... B25B 23/1453
173/93
7,647,986 B2 * 1/2010 Kettner ..... B25B 21/02
173/104

* cited by examiner

IMPACT DEVICE FOR POWER TRANSMISSION

BACKGROUND

1. Technical Field

The present disclosure relates to a transmission device of a powered tool, such as an electronic wrench or an air powered wrench, and more particularly to an impact device for power transmission.

2. Description of Related Art

Many of commercially available electronic wrenches or air powered wrenches are equipped with impact devices for power transmission therein. The impact device for power transmission is adapted to be connected with a rotation shaft of a motor mounted inside the wrench and usually composed of an output shaft and an impact mechanism. By means of the impact mechanism, the output shaft is indirectly driven by the motor to rotate to lock or loose a screw nut or bolt. While the screw nut or the bolt is locked to a certain degree which results in the output shaft hard to be further driven to rotate, the impact mechanism, which is continuously driven by the motor, will intermittently impact the output shaft to make the output shaft rotate with great torque at the instant that the output shaft receives the impact, enabling the initially locked bolt or screw nut to be locked more tightly or the tightly locked bolt or screw nut to be loosed correspondingly.

U.S. Pat. No. 5,704,434 disclosed a hydraulic torque pulse mechanism. The mechanism is a kind of impact device for power transmission by utilizing hydraulic pressure, such as oil pressure, to generate torque. This mechanism has not only power transmission function and impact function, but also advantages of low vibration and low noise due to characteristic of hydraulic pressure.

However, because of structural limitation, the hydraulic pressure of the conventional impact device utilizing the hydraulic pressure to generate torque is not adjustable, such that the conventional impact device can only output torque of a fixed value. In other words, the output torque of the conventional impact device cannot be adjusted subject to the user's demand.

SUMMARY

To solve the above-mentioned problems, one of objectives of the present disclosure is to provide an impact device for power transmission which can generate a hydraulic torque pulse and output adjustable torque.

An exemplary embodiment of the present disclosure provides an impact device for power transmission comprising an impact unit and a hydraulic pressure adjusting unit. The impact unit has a hydraulic cylinder, and a piston assembly and an output shaft both disposed inside the hydraulic cylinder for outputting torque by utilizing a hydraulic pressure provided inside the hydraulic cylinder. The hydraulic pressure adjusting unit is disposed in the hydraulic cylinder for adjusting the hydraulic pressure of the hydraulic cylinder. Therefore, the user can adjust the hydraulic pressure of the hydraulic cylinder by the hydraulic pressure adjusting unit so as to further adjust the magnitude of the torque output through the output shaft.

The detailed structure, feature, assembly and operation of the impact device for power transmission of the present disclosure are described detailedly in the following illustration of the exemplary embodiments. However, those skilled in the art would realize that the embodiment and detailed description of the present disclosure are all exemplary and are used for explaining the present disclosure, but they do not limit the meaning or the scope of the present disclosure defined in the claims.

DESCRIPTION OF THE EXEMPLARY EMBODIMENTS

Figure 1:
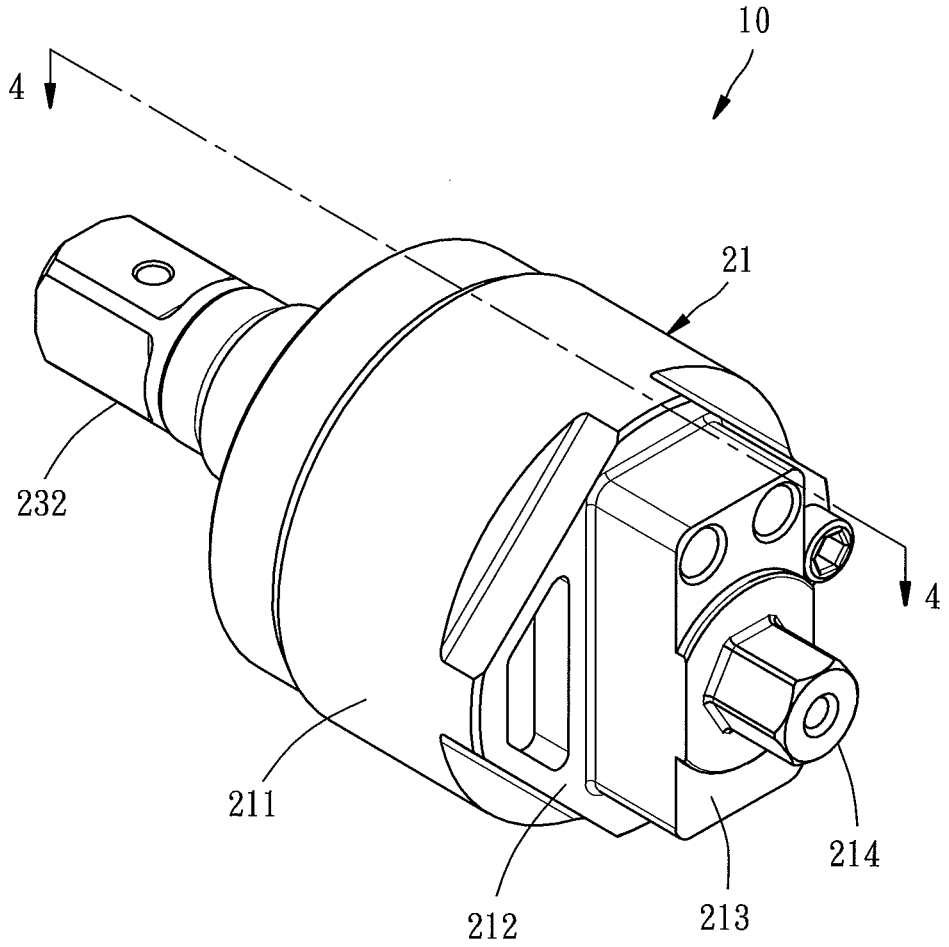
FIG. 1 is a perspective assembled view of an exemplary embodiment of an impact device for power transmission of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
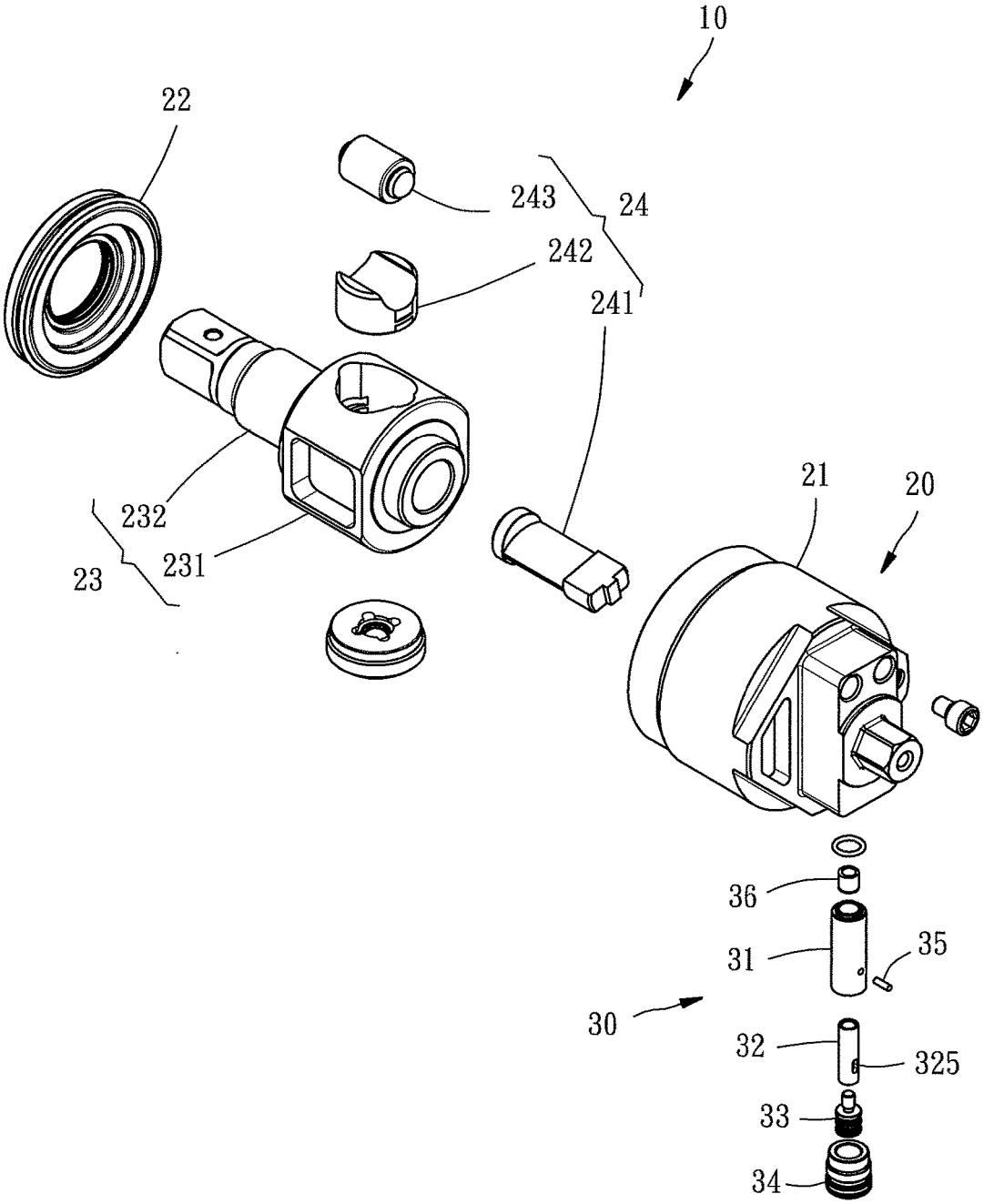
FIG. 2 is an exploded view of the exemplary embodiment of the impact device for power transmission of the present disclosure.
Figure 3:
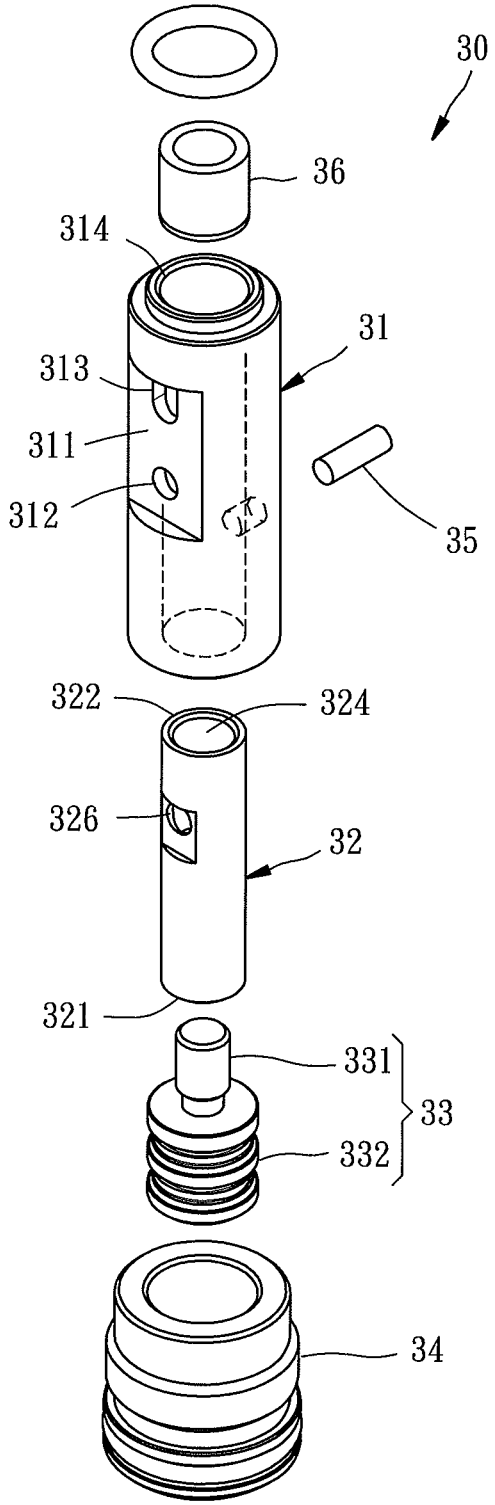
FIG. 3 is an exploded view of a hydraulic pressure adjusting unit of the impact device for power transmission of the present disclosure.

Referring to FIGS. 1-3, the impact device 10 for power transmission provided by the preferred embodiment of the present disclosure comprises an impact unit 20 and a hydraulic pressure adjusting unit 30.

The impact unit 20 is similar to a traditional impact device for power transmission utilizing hydraulic pressure to generate torque, and comprises a hydraulic cylinder 21, a front cover 22 mounted on the front end of the hydraulic cylinder 21, and an output shaft 23 and a piston assembly 24 disposed inside the hydraulic cylinder 21.

Figure 4:
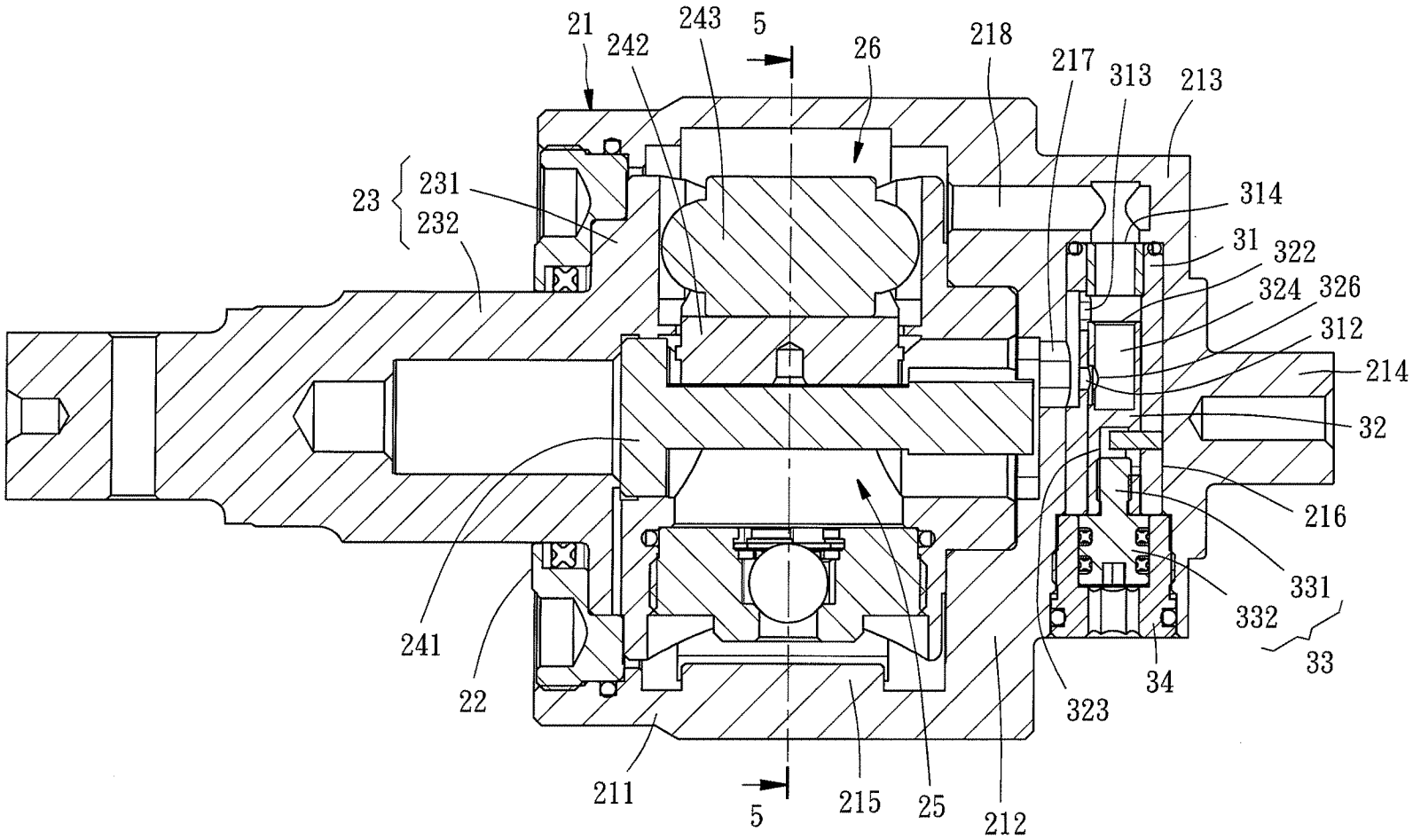
FIG. 4 is a cross-sectional view taken along line 4-4 of FIG. 1.
Figure 5:
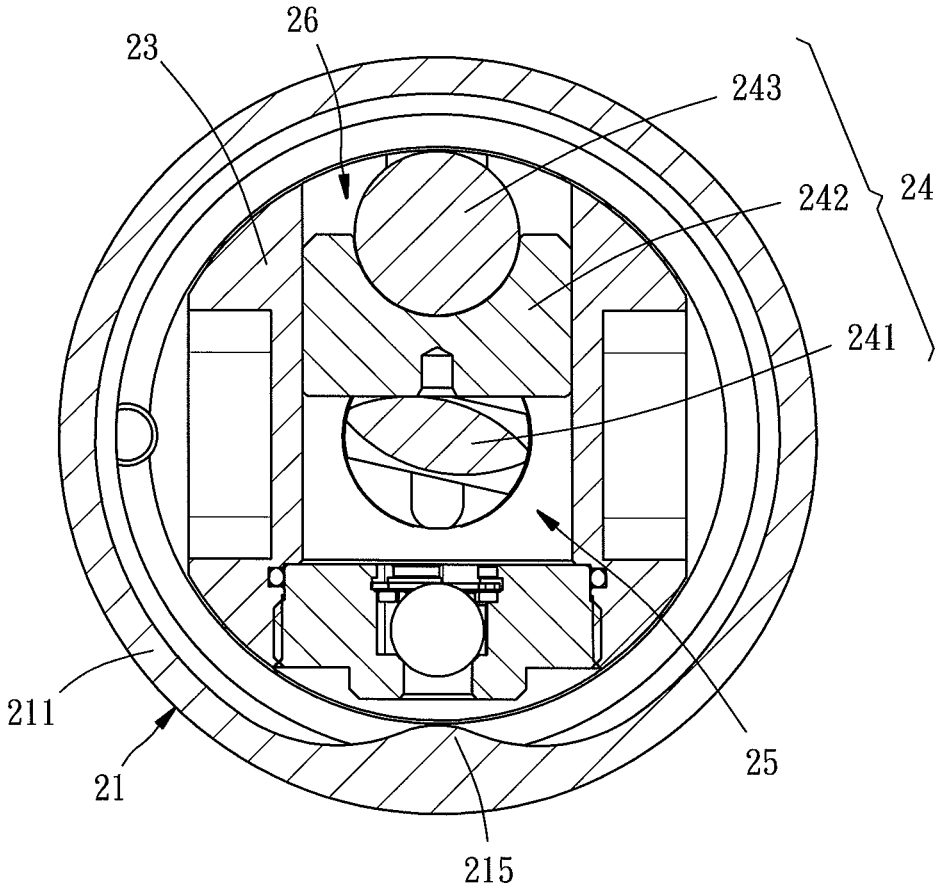
FIG. 5 is a cross-sectional view taken along line 5-5 of FIG. 4.

As shown in FIG. 4 and FIG. 5, the hydraulic cylinder 21 has a side peripheral wall 211, a back wall 212, a mounting portion 213 and a connection shaft 214 protruding on an outer side of the back wall 212, and an impact portion 215 protruding on an inner side of the side peripheral wall 211. The mounting portion 213 has a mounting hole 216, and the back wall 212 has a first channel 217 and a second channel 218 communicating with the mounting hole 216. The output shaft 23 comprises an accommodating portion 231 disposed inside the hydraulic cylinder 21, and a shaft 232 protruding out of the front cover 22. The piston assembly 24 is disposed inside the accommodating portion 231, and comprises a rotation shaft 241, a piston 242 and a pin roller 243. A liquid capable of generating a hydraulic pressure in certain degree, such as hydraulic oil, is accommodated inside the hydraulic cylinder 21 and the accommodating portion 231 of the output shaft 23.

The impact device 10 for power transmission is mainly used to be disposed in a powered tool (not shown in figures), and the connection shaft 214 of the hydraulic cylinder 21 is connected with the motor of the powered tool. The operation of the impact unit 20 is similar to the hydraulic torque pulse mechanism disclosed in U.S. Pat. No. 5,704,434. However, the hydraulic torque pulse mechanism of the aforesaid patent generates two impact actions at each turn, but the impact unit 20 of the present disclosure just generates one impact action at each turn. That is, the impact portion 215 impacts the pin roller 243 of the piston assembly 24 one time as the hydraulic cylinder 21 is driven to rotate one turn by the motor, resulting in that the output shaft 23 generates a hydraulic torque pulse.

The impact unit 20 has a first chamber 25 and a second chamber 26, which are divided by the piston 242. The first chamber 25 is communicated with the mounting hole 216 via the first channel 217, and the second chamber 26 is communicated with the mounting hole 216 via the second channel 218. The hydraulic pressure inside the first chamber 25 becomes larger, and the torque generated by the output shaft 23 while the pin roller 243 is impacted by the impact portion 215 becomes larger correspondingly. The hydraulic pressure adjusting unit 30 is disposed inside the mounting hole 216 for adjusting the hydraulic pressure of the first chamber 25. The structure and operation of the hydraulic pressure adjusting unit 30 are described detailedly in the following paragraphs.

Referring to FIGS. 2-4, the hydraulic pressure adjusting unit 30 mainly comprises a tube 31, a blocking member 32, an adjusting member 33, a bushing 34, a positioning pin 35 and a stopping ring 36.

The tube 31 has a groove portion 311 at outer side thereof, and two first openings 312 and 313 located at groove portion 311. The tube 31 is fastened inside the mounting hole 216 of the hydraulic cylinder 21. The groove portion 311, the two first openings 312 and 313 are communicated with the first chamber 25 via the first channel 217. The tube 31 further has a second opening 314 at an end thereof. The second opening 314 is in communication with the second chamber 26 via the second channel 218.

The blocking member 32 is shaped like a cylinder having a threaded hole 323 with an opening at an end surface of the blocking member 32 and an accommodating groove 324 with an opening at the other end surface of the blocking member 32. The blocking member 32 further has an elongated hole 325 and a round through hole 326, which are communicated with the threaded hole 323 and the accommodating groove 324, respectively. The threaded hole 323 extends from the end 321, namely the first ends, toward the other end 322, namely the second end of the blocking member 32, and the accommodating groove 324 is recessed from the second end 322 toward the first end 321 of the blocking member 32 in such a way that the accommodating groove 324 is not in communication with the threaded hole 323.

The adjusting member 33 is a bolt having a screw 331 and a head portion 332 connected with an end of the screw 331. The screw 331 is disposed inside the threaded hole 323 and screwingly engaged with the blocking member 32. The blocking member 32 is disposed inside the tube 31. The bushing 34 is sleeved onto the head portion 332 of the adjusting member 33 and fastened in the mounting hole 216 of the hydraulic cylinder 21 in such a way that the head portion 332 of the adjusting member 33 is pressed against the tube 31. In addition, the through hole 326 of the blocking member 32 corresponds in location to the first openings 312 of the tube 31, and the end 322 of the blocking member 32 corresponds in location to the first opening 313 of the tube 31. The two first openings 312, 313 are communicated with the accommodating groove 324.

Figure 6:
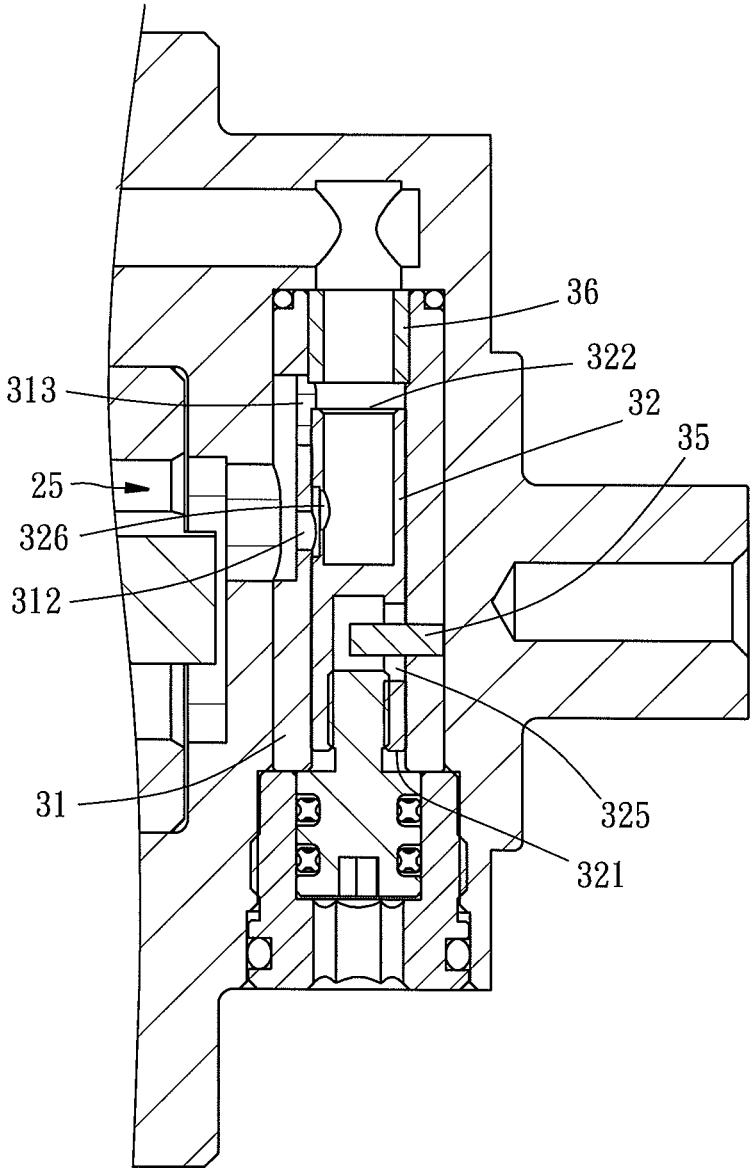
FIG. 6 and FIG. 7 are enlarged views of a part of FIG. 4, showing a blocking member of the hydraulic pressure adjusting unit is located at different positions compared to FIG. 4.
Figure 7:
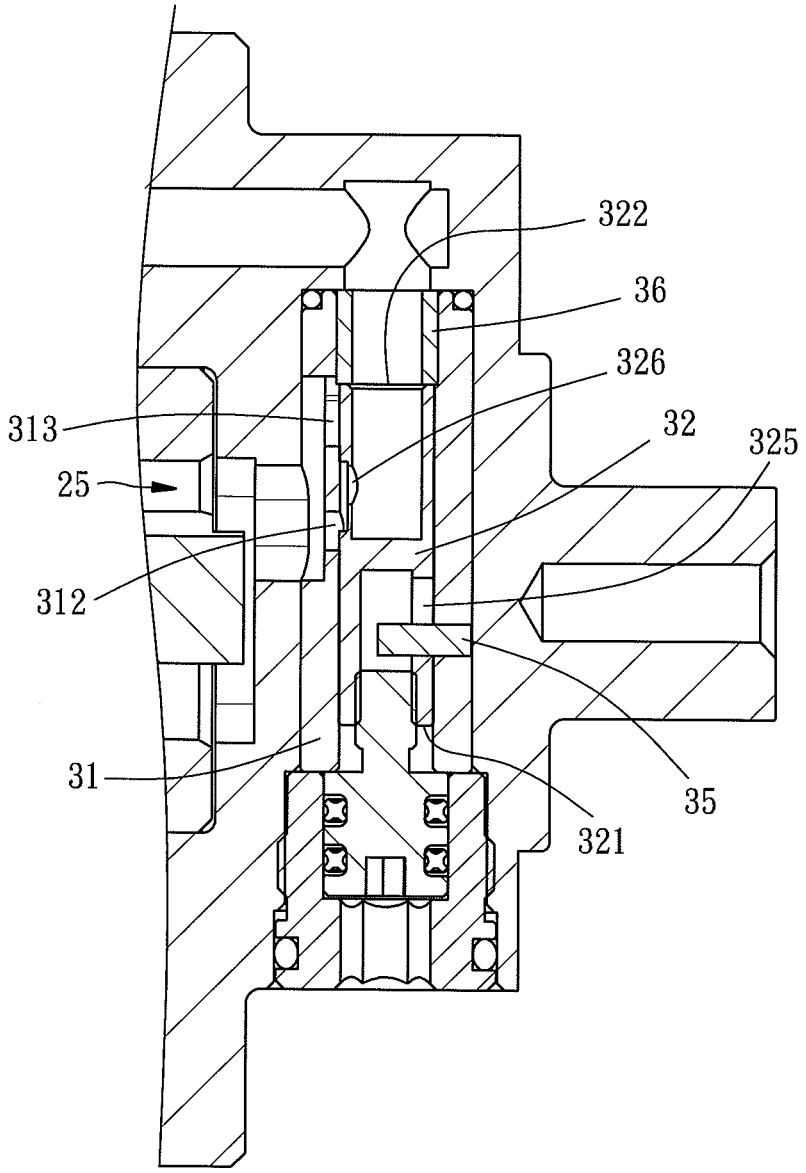

By the above-mentioned structural arrangements, the user can insert a screwdriver into the bushing 34 to rotate the adjusting member 33. Because the head portion 332 of the adjusting member 33 are constrained by the tube 31 and the bushing 34 in a way that the adjusting member 33 can only rotate but not move axially, the rotation of the adjusting member 33 will drive the blocking member 32 to axially move relative to the tube 31. When the blocking member 32 is moved and positioned at the position shown in FIG. 4, the first opening 312 of the tube 31 is completely in alignment with the through hole 326 without being blocked by the blocking member 32, and only a small part of the first opening 313 is blocked by the blocking member 32. In this condition, when being pushed by the piston 242, the liquid inside the first chamber 25 flows into the hydraulic pressure adjusting unit 30 in a larger flow rate, such that the hydraulic pressure of the first chamber 25 becomes smaller. When the blocking member 32 is moved and positioned at the position shown in FIG. 6, about half area of each of the first openings 312 and 313 is blocked by the blocking member 32. In this condition, when being pushed by the piston 242, the liquid inside the first chamber 25 flows into the hydraulic pressure adjusting unit 30 in a smaller flow rate, such that the hydraulic pressure of the first chamber 25 becomes larger. When the blocking member 32 is moved and positioned at the position shown in FIG. 7, each of the first openings 312 and 313 is completely blocked by the blocking member 32. In this condition, the liquid inside the first chamber 25 can hardly flow into the hydraulic pressure adjusting unit 30, such that the first chamber 25 may have the maximum hydraulic pressure.

In other words, the user can rotate the adjusting member 33 to selectively enable the blocking member 32 to block the first opening 312 and 313 of the tube 31, and adjust the area of the two first openings 312 and 313 being blocked by the blocking member 32, so as to adjust magnitude of the hydraulic pressure in the first chamber 25, such that the output shaft 23 can generate torque with different values subject to the user's requirement.

The positioning pin 35 is fastened in the tube 31 and inserted into the elongated hole 325 of the blocking member 32 to constrain displacement range of the blocking member 32 and to prohibit the blocking member 32 from rotation for enabling the adjusting member 33 to drive the blocking member 32 to move axially. In addition, the stopping ring 36 is mounted inside the tube 31 to constrain the blocking member 32 between the stopping ring 36 and the head portion 332 of the adjusting member 33, so that the displacement range of the blocking member 32 can be limited. However, the present disclosure may not have the technical feature for limiting displacement range of the blocking member 32.

It is noted that the tube 31 may be configured having just one first opening. In the condition that the tube 31 has just one first opening, the blocking member 32 is moveably disposed in the tube 31 in a way that the through hole 326 or the end 322 of the blocking member 32 corresponds in location to the first opening, such that the area of the first opening that is blocked can be adjusted while the blocking member 32 is moved, so as to adjust the hydraulic pressure. It means that the effect of adjusting the hydraulic pressure can be achieved without providing the through hole 326 in the blocking member 32. In addition, the stopping ring 36 can be integrally formed with the tube 31, and the tube 31 can also be integrally formed with the hydraulic cylinder 21. Such modification of design is the same as the structure of this embodiment and can achieve equivalent effect; therefore, they should be covered by the scope of the present disclosure.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An impact device for power transmission, comprising:

an impact unit having a hydraulic cylinder, and a piston assembly and an output shaft disposed inside the hydraulic cylinder for generating torque through the output shaft by utilizing a hydraulic pressure provided inside the hydraulic cylinder; and a hydraulic pressure adjusting unit disposed in the hydraulic cylinder and configured for adjusting the hydraulic pressure of the hydraulic cylinder, wherein the impact unit has a first chamber and a second chamber, and the hydraulic pressure adjusting unit comprises a tube, a blocking member and an adjusting member; the tube has at least one first opening communicated with the first chamber, and a second opening communicated with the second chamber; the blocking member is disposed inside the tube and selectively blocks the at least one first opening; the adjusting member is configured for enabling the blocking member to be movably disposed in the tube and mounted with the adjusting member for adjusting an area of the first opening that is blocked by the blocking member.

2. The impact device as defined in claim 1, wherein the blocking member has a through hole corresponding in location to the first opening.

3. The impact device as defined in claim 1, wherein the blocking member has an end corresponding in location to the first opening.

4. The impact device as defined in claim 1, wherein the tube has a groove portion communicated with the first chamber and provided with two said first openings; the blocking member has a through hole corresponding in location to one of the first openings, and an end corresponding in location to the other of the first openings.

5. The impact device as defined in claim 1, wherein the blocking member has a threaded hole and the adjusting member has a screw engaged with the threaded hole for driving the blocking member to move.

6. The impact device as defined in claim 5, wherein the hydraulic pressure adjusting unit further comprises a bushing and the adjusting member further has a head portion connected to an end of the screw; the bushing is fastened in the hydraulic cylinder to press the head portion of the adjusting member against the tube.

7. The impact device as defined in claim 5, wherein the blocking member has a first end and a second end; the threaded hole has an opening at a end surface of the first end of the blocking member; the blocking member further has an accommodating portion recessed from the second end and communicated with the first opening.

8. The impact device as defined in claim 1, wherein the hydraulic pressure adjusting unit further comprises a stopping ring mounted in the tube; the blocking member is constrained between the stopping ring and the adjusting member.

9. The impact device as defined in claim 1, wherein the blocking member has an elongated hole; the hydraulic pressure adjusting unit further comprises a positioning pin fastened in the tube and inserted into the elongated hole.

* * * * *